US007903834B1

(12) United States Patent
Graber

(10) Patent No.: US 7,903,834 B1
(45) Date of Patent: Mar. 8, 2011

(54) CURVE FITTED ELECTRODYNAMIC PLANAR LOUDSPEAKER

(76) Inventor: Curtis E. Graber, Woodburn, IN (US)

( * ) Notice: Subject to any disclaimer, the term of this patent is extended or adjusted under 35 U.S.C. 154(b) by 1678 days.

(21) Appl. No.: 11/145,271

(22) Filed: Jun. 3, 2005

(51) Int. Cl.
*H04R 1/02* (2006.01)
*H04R 1/00* (2006.01)

(52) U.S. Cl. ..... 381/336; 381/334; 381/338; 381/335; 381/408; 381/431; 381/432; 381/423

(58) Field of Classification Search ..... 381/334–338, 381/432, 423, 408, 431
See application file for complete search history.

(56) References Cited

U.S. PATENT DOCUMENTS

| | | | | |
|---|---|---|---|---|
| 6,104,825 | A * | 8/2000 | Thigpen | 381/408 |
| 6,687,381 | B2 | 2/2004 | Yanagawa et al. | |
| 7,206,427 | B2 * | 4/2007 | Simidian et al. | 381/335 |
| 7,236,608 | B2 * | 6/2007 | Garner | 381/399 |
| 2003/0228029 | A1 | 12/2003 | Graebener | |
| 2004/0182642 | A1 | 9/2004 | Hutt et al. | |
| 2005/0157904 | A1 * | 7/2005 | Steere et al. | 381/431 |

* cited by examiner

*Primary Examiner* — Devona E Faulk
(74) *Attorney, Agent, or Firm* — Paul W. O'Malley

(57) ABSTRACT

A curve fitted planar loudspeaker minimizes variation and dead zones in the sound field propagated by an array of the loudspeakers. The curve fitted loudspeaker provides a plurality of sound generating transducers. The diaphragm is curved and each adjacent section fits as a section into a larger curve, eliminating or minimizing breaks in the propagated sound filed at the target distance to the target.

16 Claims, 6 Drawing Sheets

PROGRESSIVE CURVE CURVE FITTED ELEMENT

PROGRESSIVE CURVE STRAIGHT ELEMENTS

UNIFORM CURVE STAIGHT ELEMENTS

CURVE FITTED ELECTRODYNAMIC PLANAR LOUDSPEAKER

BACKGROUND OF THE INVENTION

1. Technical Field

The invention relates to loudspeakers and more particularly to planar or ribbon type loudspeakers fitted to be used in a hanging array of loudspeakers.

2. Description of the Problem

Electro-dynamic planar loudspeakers are constructed using a thin resistive film diaphragm disposed taut over a thin, rectangular frame. Permanent magnets are mounted within the frame parallel with at least one, and sometimes both, of the major surfaces of the thin film diaphragm. In prior art designs, the bar magnets align with the axis of the direction of elongation of the frame. Typically one major surface of the thin film diaphragm carries electrically conductive traces which are etched from a layer of aluminum applied to the major surface. The conductive traces are positioned with respect to the permanent magnets so that electrical currents applied to the conductive traces result in forces being generated which move the diaphragm. The major surfaces of the diaphragm are enclosed between the magnets adjacent one major surface and, typically, a grate or sound lens adjacent the opposite major surface.

The introduction of a varying current to the electrically conductive traces causes motive force to be generated on the thin film conductors, and corresponding movement of the thin film diaphragm in the frame. The diaphragm and electrically conductive traces are of minimal mass to minimize energy expended moving the diaphragm and to optimize response times. A carefully calibrated and even tension should be applied to the diaphragm along its entire perimeter. Consistent spacing between the diaphragm and the magnets contributes to minimization of distortion in sound reproduction.

Planar type loudspeakers have a defined acoustical directivity pattern that has a natural application to vertically hung arrays. In such an array a long chain of speakers produces a sound field having broad area coverage. Such arrays are usually constructed to curve rearwardly at the bottom of the curve to produce a shallow J-shaped or fish hook profile. This arrangement orients the lowest loudspeakers in the chain to present their sound emitting surfaces directly toward the portion of the audience sitting below the array. A J-shaped curved array typically has an elongated upper portion which is substantially straight, from which sound is directed outwardly, and a lower, curved portion, from which sound is directed downwardly.

It is usually desirable that listeners anywhere in the covered area hear substantially the same sound. Achieving this result is very difficult in practice. One difficulty has been that the lower, curved portion of the J curve array has exhibited excessively large granularity. The term "granularity" is used to refer to the number and size of dead zones vertically disposed in a sound field. With conventional planar loudspeakers, the fewer the number of dead zones, the larger the dead zones tend to be. Fine granularity splits up dead zones to reduce their size below the threshold of human detection. The use of straight planar loudspeakers in the curved portions of a hanging array results in the appearance of obtrusive dead areas in the projected sound field. The lowest practical limit on the length of planar loudspeakers still results in J-curve arrays where the loudspeakers poorly fit the curve of the array. This results in substantial dead spots in the sound field. It is desirable to avoid use of short planar loudspeakers on account of their expense, power handling considerations and the poor low frequency response of very short planar devices.

SUMMARY OF THE INVENTION

The invention provides a planar loudspeaker. Each loudspeaker has front and back panels. The front and back panels each have front and back major surfaces. The front panel has an aperture connecting the panel's front and back major surfaces. The aperture allows sound energy to escape. A back panel has front and back major surfaces which are congruent to the front and back major surfaces of the front panel. An aperture connects the front and back major surfaces of the back panel. The front major surface of the back panel is disposed substantially abutting the back major surface of the front panel. A diaphragm is located between the front panel and the back panel and is aligned on the apertures, its major surfaces being parallel to the planes of the apertures. Vibration of the diaphragm produces sound which is emitted through the apertures. The front panel includes at least a first bridge dividing the aperture through the front panel. This bridge or brace is disposed in contact with a major surface of the diaphragm to divide the diaphragm into sections on its front major surface. A corresponding bridge is provided across the aperture on the back panel. Independent circuit traces are disposed on each section of the diaphragm for both major surfaces, corresponding to the sections of the diaphragm. A plurality of bar magnets, arranged in arrays, are disposed one array to each section of the apertures in the sections of the back and, usually, front apertures to complete the transducer assembly.

The planer loudspeaker is elongated from end to end and conforms locally to the curve of a J-hook vertical array of planar loudspeakers in which it is used. The front and back panels are shaped from end to end in their direction of elongation to conform to a curve. The bar magnets in each section being are oriented parallel to a bridge bordering the section. The bar magnets associated with the front panel, when used, being are narrower than those disposed in the sections of the aperture through the back section and are stepped with respect to one another to maintain spacing from the diaphragm.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
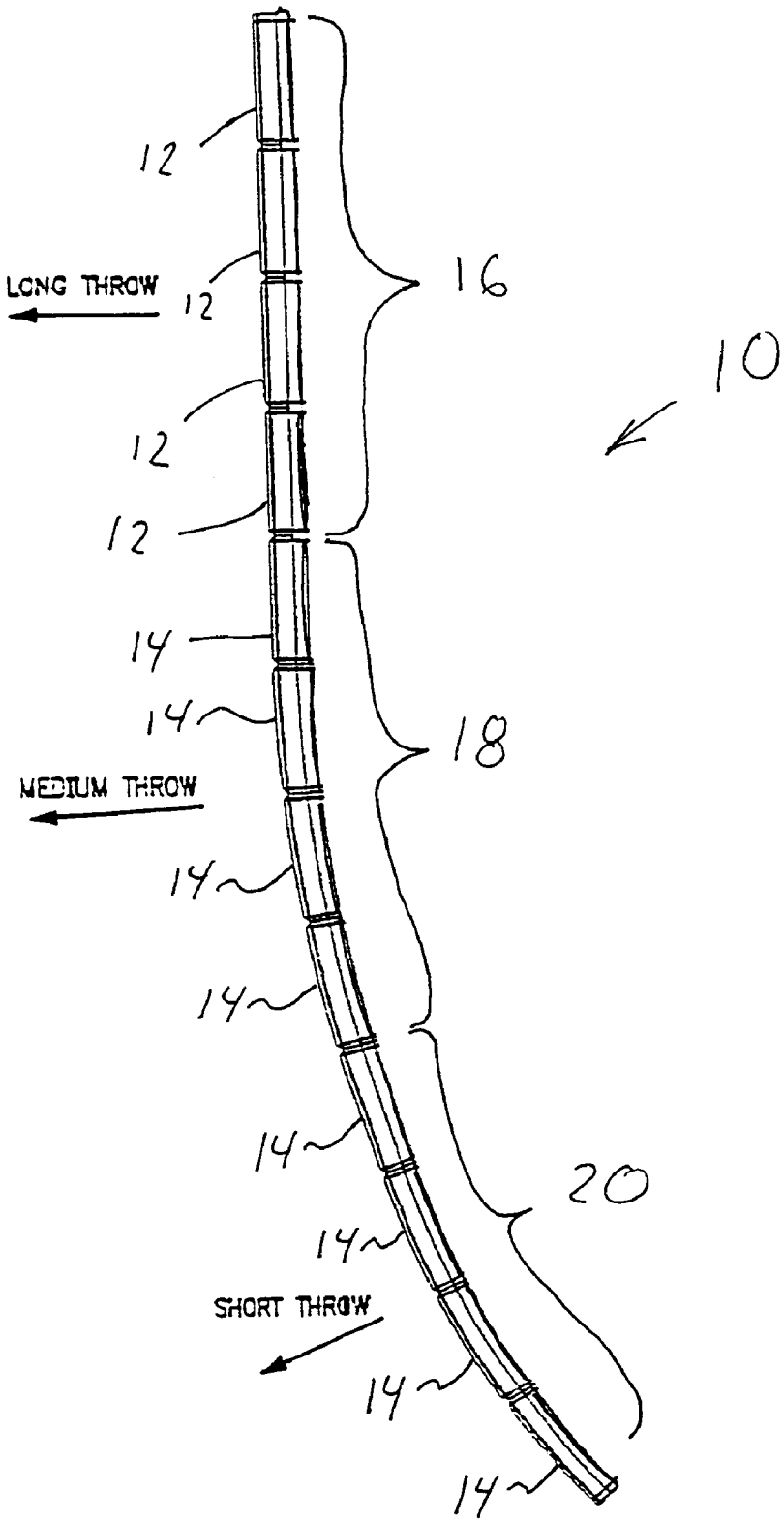
FIG. 1 is a side view of a stacked ribbon array of planar loudspeakers.

Referring to FIG. 1 an array 10 of planar loudspeakers, assembled as and hung in a J-curve, is illustrated. Ribbon array 10 comprises both flat curve planar loudspeakers 12 used in a straight, long throw, portion 16 in the upper part of the ribbon array 10 and curve fitted planar loudspeakers 14 used in the medium and short throw portions 18, 20, filling out the lower portion of the array. The planar loudspeakers 12, 14 are connected end to end in a strip to construct the array. Alternatively, a frame may be used to support the loudspeakers 12, 14 in such an end to end arrangement and relieve the loudspeaker units themselves of the need to be constructed to support the weight of the portion of array 10 suspended from a particular unit. Array 10 is typically used in an arena type setting, hanging from its upper end from the roof or rafters over the floor space of the arena. It is intended to fill efficiently the space of the arena with a sound field, with areas underneath array 10 being taken care of by the short throw section 20, intermediate locations being covered by the medium throw section 18 and more distant areas covered by long throw section 16.

Figure 2C:
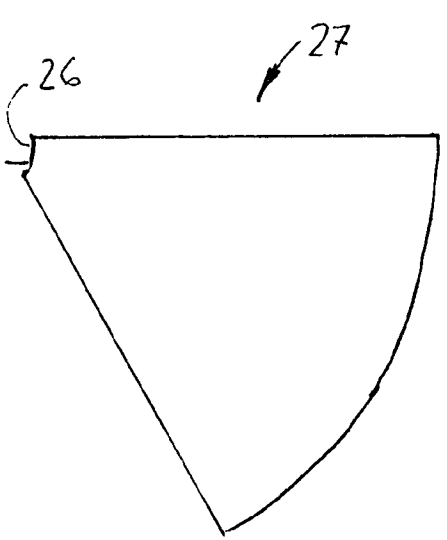
FIGS. 2A-C are diagrams illustrating sound field coverage from ribbon arrays of loudspeakers using conventional loudspeakers and curve fitted planar loud speakers of the present invention.
Figure 2B:
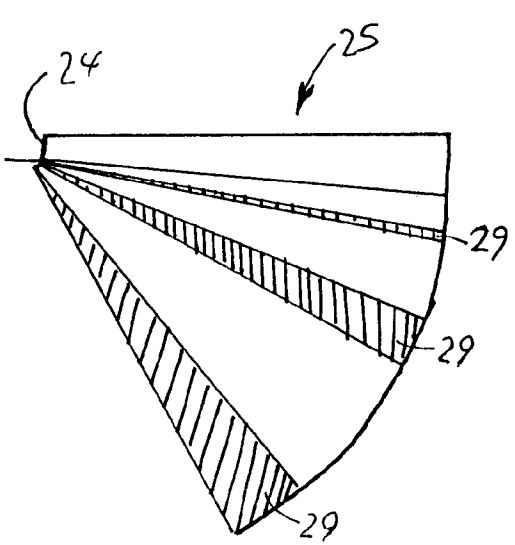
Figure 2A:
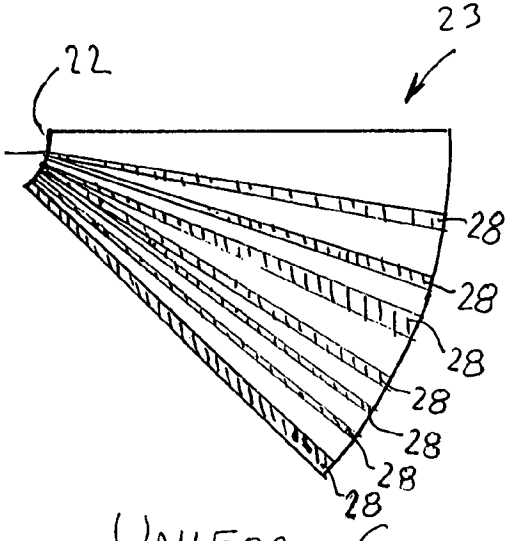

FIGS. 2A-C illustrate sound fields 23, 25, 27 produced by arrays of loudspeakers. Sound field 23 is generated by an array of conventional planar loudspeakers 12 hung to conform to a uniform curve 22. A plurality of substantially evenly spaced dead zones 30 (shown by hatching) of uniform width appear in the sound field 23. Sound field 25 is produced by an array of conventional loudspeakers 12 hung to conform to a progressive curve. Sound field 25 exhibits fewer dead zones 31, which are progressively more widely spaced, but which grow progressively in width from the top of the field to the bottom. In essence, the dead zones are collected and grouped vis-a-vis sound field 23. Lastly, sound field 27 represents the result of using a hanging array of curve fitted loudspeakers 14 in a progressive curve. While dead zones exist, their fine granularity is such as to keep them from being noticed by the average human listener. As will become clearer later in this discussion, the dead zones have in effect, been finely broken up into many small pieces.

Figure 3:
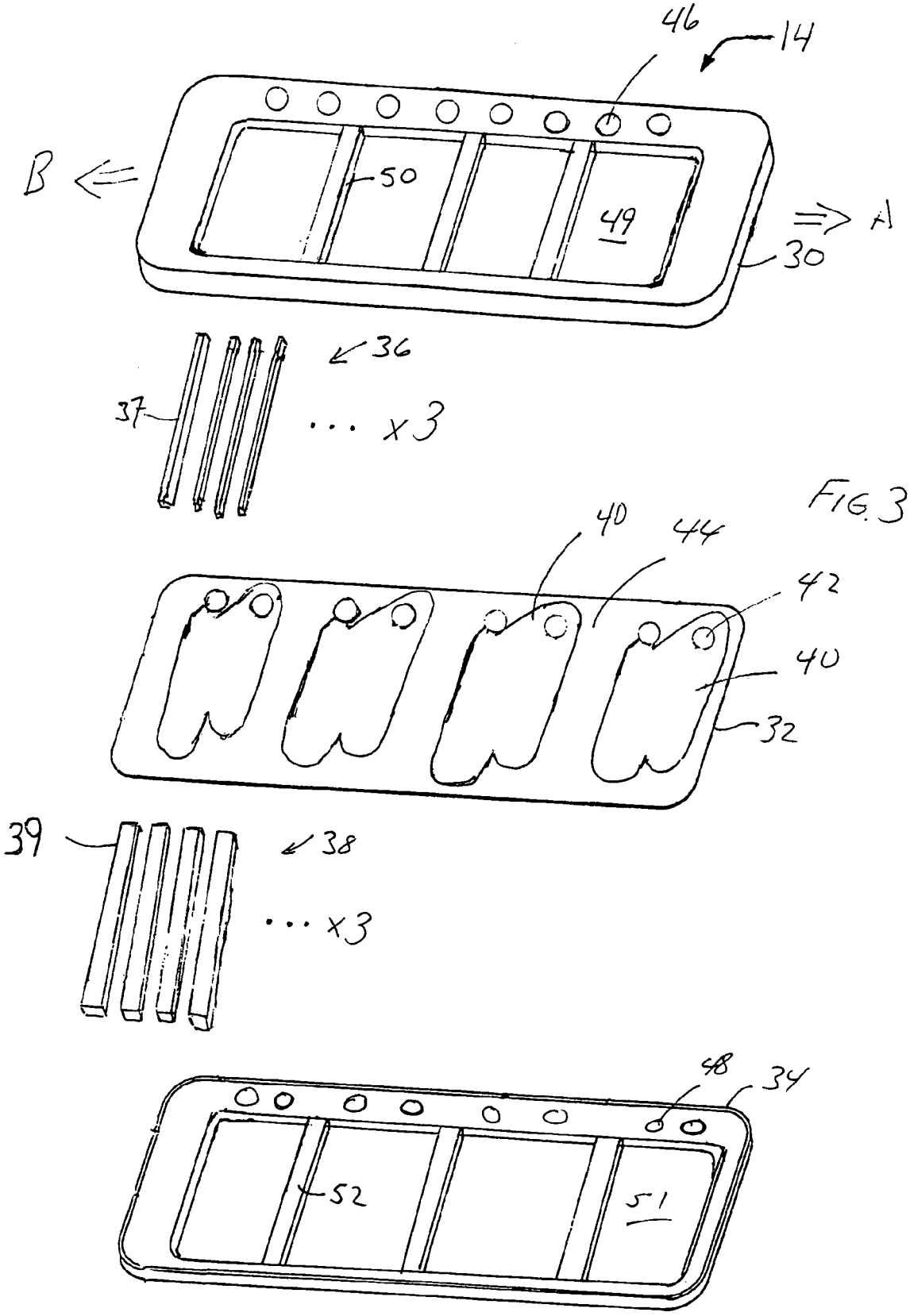
FIG. 3 is an exploded view of a planar loudspeaker in accord with the invention.

FIG. 3 is an exploded view of a curve fitted planar loudspeaker 14 in accordance with a preferred embodiment of the invention. Arrows A and B indicate the direction of elongation of the element. The more widely spaced edges of the loudspeaker 14 fall adjacent to the ends of neighboring loudspeakers 12, 14 in array 10. A rear panel 34 attaches to the back of front panel 30 with a diaphragm 32 fitted between the panels and held across aperture 49 and a corresponding rear panel aperture. Front panel 30 includes a center aperture 49 between its major front and rear surfaces from which sound escapes. First, second and third diaphragm braces 50 extend across center aperture 49 from elongated side to elongated side, dividing aperture 49 into four sections. The braces 50 (and 52) also abut the diaphragm 32 into sections, allowing each section to vibrate independently.

Rear panel 34 is similar to front panel 30. The rear panel 34 is also elongated and has a center aperture 51 connecting its front and back major surfaces. First, second and third diaphragm cross braces 52 extend between the elongated sides of the aperture, are oriented perpendicular to the direction of elongation of the panel and are aligned on the cross braces 50 of the front panel 30. Diaphragm 32 is also held taut over aperture 51. Panels 30, 34 are preferably milled aluminum but may be stamped in some applications.

Current carrying circuits are conventionally provided using electrical traces etched on one or both of the major surfaces of the diaphragm 32. More exotic systems may be used as they become available. Electrical connection terminals 48 are provided on the outer major surfaces of front panel 30 and rear panel 34 for electrical traces located on both major surfaces of the diaphragm 32. These provide points for the external connection of electrical leads and for connection to the conductive traces 40 disposed on both major surfaces of diaphragm 32. Diaphragms can be divided into multiple sections, and not just the four sections illustrated. Each section has one or two conductive traces 40. Where there are two conductive traces 40 they are provided front and back on the diaphragm.

Diaphragm 32 is a conventional thin film made of a synthetic polyamide or a similar material. Electrical traces 40 are disposed on both the front and back major surfaces of the film including front surface 44. Traces 40 are replicated four times on both major surfaces of diaphragm 34 (only the front surface 44 traces are shown, those of the rear surface being identical). Each conductive trace 40 is provided with its own set of electrical terminals 42 allowing each trace to be independently energized. Conductive traces 40, when located in a magnetic field and energized by an electrical current, move and in doing so impart motion to diaphragm 32. The magnetic field is supplied using bar magnets on both sides of diaphragm 32. Magnets 37, 39 are provided in four sets 36, 38 of four magnets each, corresponding to the conductive traces 40 laid out on the diaphragm, front and back. The magnets in each set are elongated neo or bar magnets, laid parallel to one another and extending between the elongated sides of the center apertures 49, 51, in parallel to the diaphragm braces 50, 52, respectively. The bar magnets of each of sets of magnets 36 placed in front of diaphragm 32 are placed in the subapertures of center aperture 49 defined by diaphragm braces 50. Four bar magnets 37 are illustrated in each subaperture, the magnets being oriented parallel to the braces 50. However, a different magnetic topology could be used and a greater or fewer number of magnets could be present. Gaps between the magnets 37 provide outlets for the sound generated by movement of diaphragm 32 and define an acoustic lens across the aperture.

Otherwise magnets 39 are disposed with respect to rear panel 34 and the rear major surface of diaphragm 32 just as magnets 37 are with respect to the other side of the diaphragm. Magnets 39 fitted to the subdivisions of aperture 51 are substantially wider than magnets 37 with correspondingly smaller gaps between the magnets. Magnets 37 along front panel 30 are preferably narrower and shallower than magnets 39 supported along the back panel 34. The gaps between magnets along the front panel 30 thus are wider and shallower. This arrangement improves the forward off axis dispersion of the sound field, particularly helping off axis linearity of high frequencies in the sound field.

Figure 4:
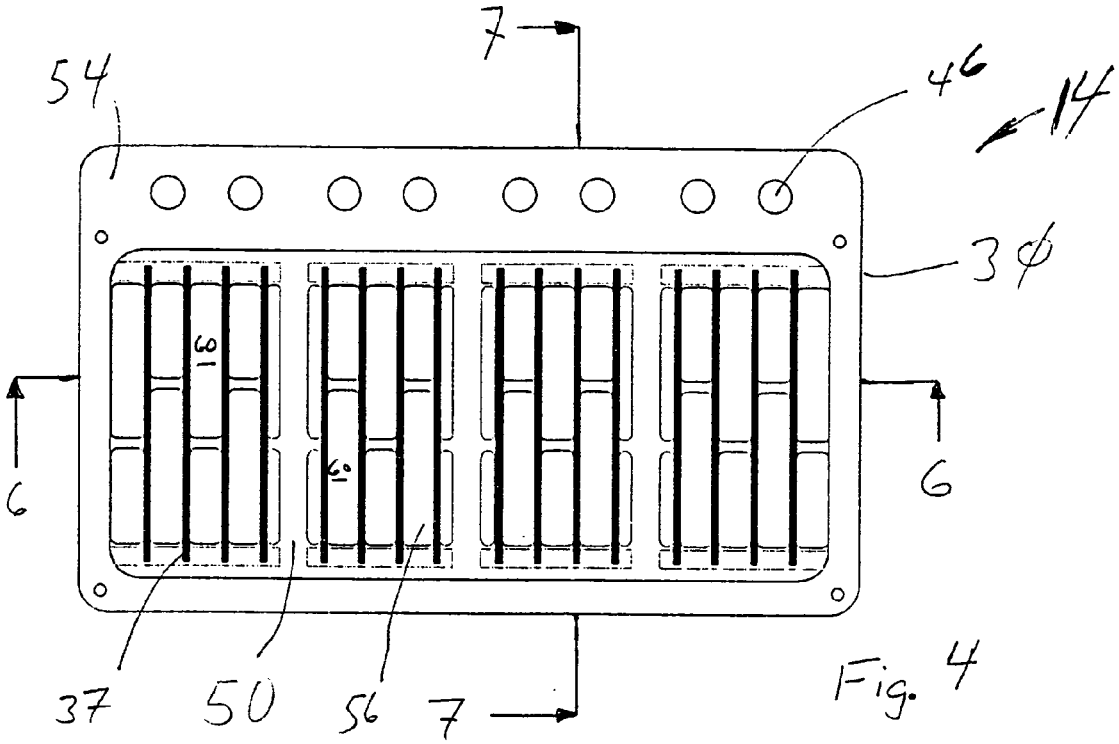
FIG. 4 is a front view of view of a planar loudspeaker according to the invention.

Referring to FIG. 4, a front plan view of curve fitted loudspeaker 14 illustrates its front major surface 54. An acoustic lens 56 forward from diaphragm 40 is defined by the braces 50 and permanent magnets 37 disposed in and across the center aperture of front panel 30 in front of the diaphragm. Acoustic lens 56 is in effect a grating over the sound generating element of curve fitted planar loudspeaker 14, defining a plurality elongated slots 60 over each of four sections of the front major surface 44 of diaphragm 40, as defined by the location of conductive traces 40. Electrical connection points 46 are provided on the surface and connect through front panel 30 into contact with electrical leads on diaphragm 32.

Figure 5:
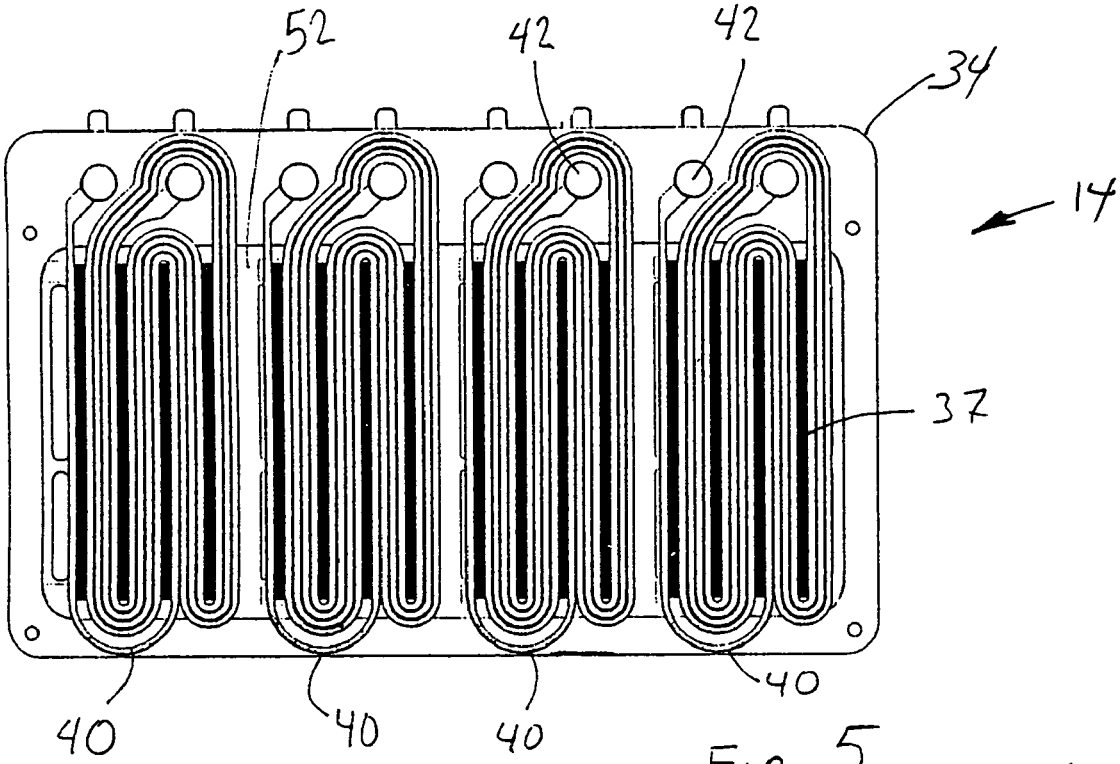
FIG. 5 is a view of the planar loudspeaker with its front panel removed to expose a diaphragm set on the frame of the loudspeaker.

Referring to FIG. 5, curve fitted planar loudspeaker 14 is illustrated with front panel 30 and forward magnet arrays 36 shown removed to expose diaphragm 32 positioned on back panel 34. Four conductive traces 40, which function as diaphragm voice coils, are positioned centered between the diaphragm braces 52 and/or the outside ends of back panel 34, with one trace from each major surface of the diaphragm positioned in front of one each of the arrays 38 of permanent magnets 39.

Figure 6:
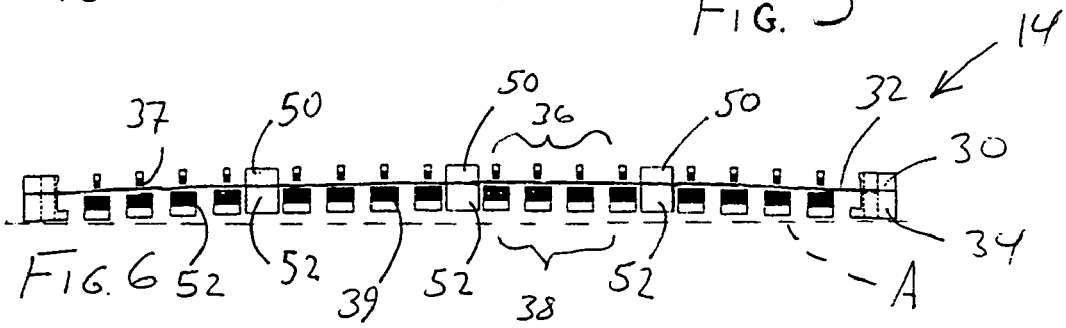
FIG. 6 is a cross sectional view taken along section lines 6-6 in FIG. 4.

Referring to FIG. 6, curve fitted planar loudspeaker 14 is illustrated in cross section from end to end in the direction of elongation of the loudspeaker. Curve fitted planar loudspeaker 14 bulges outwardly along its forward surface toward the center along its longitudinal axis, as may be seen by comparison to a phantom reference line A. The bulge is shaped to fit the curve of a hanging array 10 at the point at which the loudspeaker 14 is to be fitted. The bulge or curve of loudspeaker 14 may be chosen to fit uniform or progressive curves of varying radii. The division of planar loudspeaker 14 into divisions meets the objective of keeping the diaphragm 32 substantially evenly spaced relative to each array of magnets 36, 38. Diaphragm braces 50, 52 help support the curve of diaphragm 32 from end to end. The diaphragm braces or bridges 50, 52 locally maintain a consistent location of the diaphragm relative to the magnets 37, 39. The perimeter edges of the diaphragm 32 are held between front and back panels 30, 34. Magnets 37, 39 are arrayed in a stepped pattern to keep their spacing from diaphragm 32 even. This results in the magnetic field through the diaphragm 32 also being substantially even. For planar loudspeakers 12, which are flat, the division of diaphragm 32 into sections may still be utilized to allow shaping of the resultant sound field.

Figure 8:
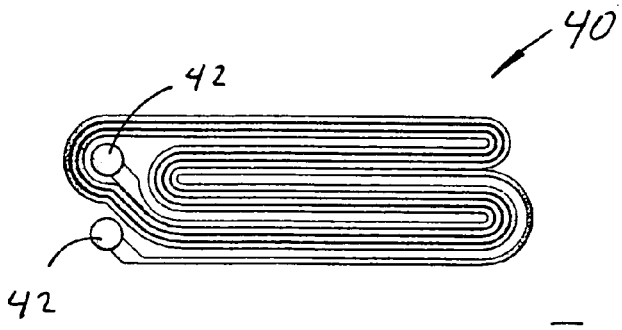
FIG. 8 is an illustration of a conductor trace pattern as used on diaphragms for planar loudspeakers of the invention.
Figure 7:
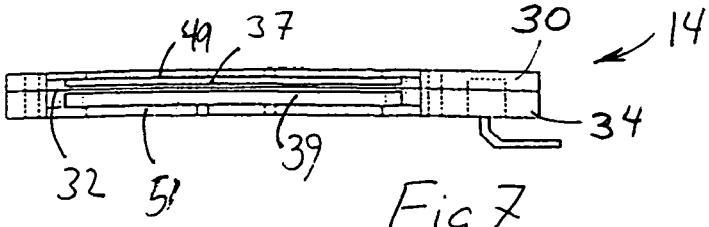
FIG. 7 is a cross sectional view taken along section lines 7-7 in FIG. 4.

FIG. 7 illustrates curve fitted planar loudspeaker 14 in cross section from side to side, in which magnets 37, 39 extend substantially across apertures 49, 51. FIG. 8 illustrates a representative conductive trace 40 as might be applied to either major surface of diaphragm 32.

Figure 9:
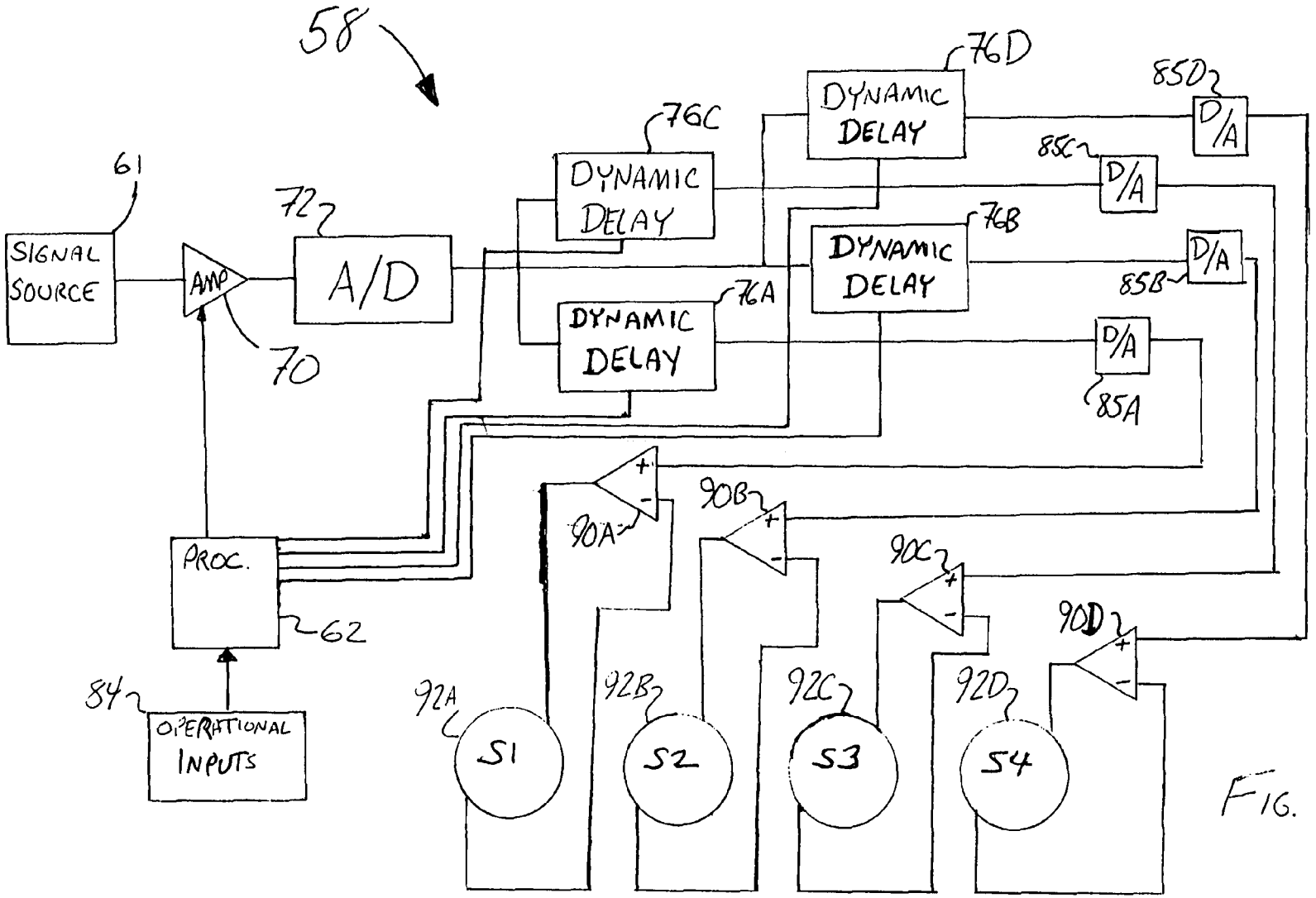
FIG. 9 is a block diagram of a circuit for controlling segments of a planar loudspeaker element of the present array.

FIG. 9 illustrates audio input signal conditioning circuitry 58. Pairs of conductive traces 40, aligned from front and back along the length of diaphragm 32, are driven synchronized with one another, but may be driven independently from adjacent pairs of conductive traces. Thus each section of the four sections of a single curve fitted planar loudspeaker 14 can be, but is not required to be, independently driven. Each of the four sections of a single curve fitted planar loudspeaker 14 is represented by four speaker transducers (S1-S4) 92A-D. Typically a single audio input signal is phase or time delayed by an amount calculated to meet audio or psychoacoustic objectives. For example, it may be desired that projected sound be synchronized when it intersects a boundary, such as the seating area on the floor of a large auditorium. As an alternative, it may be desirable to shape a sound field by compressing or expanding it in a vertical plane.

Generation of sound may be initiated electronically upon microprocessor 62 receiving a trigger signal from a source of operational inputs 84. The source of the audio input signal is a signal source 61, which may a sound reproduction system, the mixed output of a plurality of microphones, or a blend of sources. Signal source 61 provides an audio input signal to an adjustable amplifier 70 under the control of processor 62. Processor 62 controls the output amplitude to achieve the preferred sound pressure level at the target distance for the particular curve fitted planar loudspeaker 14. The target distances for individual sections of a single planar loudspeaker 14 should be so close as to not necessitate individual amplitude adjustment for each section of the planar loudspeaker. However, if this not the case, the gains for the final drive amplifiers 90A-D could be made adjustable.

Following preamplification, the audio input signal is converted to a digital signal by analog to digital converter 72 to ease further modification of the signal. A variety of modifications to the signal are possible, but the only one illustrated for the preferred embodiment is a series of dynamic delay elements 76A-D. The four dynamic delay elements 76A-D are parallel elements and effectively divide the digitized audio input signal into four channels corresponding to the four sections of the planar loudspeaker 14 with slight phase or time delay differences between the four channels. In the preferred embodiment it may be desirable that every listener in an auditorium hear exactly the same thing at the same moment. While segmentation of the drivers in the planar loudspeaker 14 of the invention allows the planer to be fitted to a curve, it also allows fine adjustment of sound front generated by a vertical array of planar loudspeakers built in accordance with the invention.

Each of the phase differentiated, digitized, audio input signals are then applied to a different one of the four analog to digital converters 85A-D to provide an analog drive signal for each of speaker transducers 92A-D, respectively. These signals are amplified by application to amplifiers 90A-D before application to speaker transducers 92A-D.

It is not necessary that all loud speakers in an array be driven synchronously. Nor is necessary that all segments of a particular planar loudspeaker be driven synchronously. Segmentation of the conductive traces and providing differentiated sound driver facilities for each segment or speaker drive channels allows each segment to be independently controlled. Circuitry to effect such operation can take a number of different forms. With the planar loudspeakers arrayed aligned with the alignment of the segments within each planar, sound generation can be readily steered upwardly, downwardly, vertically collapsed, or vertically expanded. In addition, digital signal processors can be programmed in a number of different ways to implement equivalent circuits to that illustrated in FIG. 9.

The present invention provides a curve fitted planar loudspeaker which can be used in an elongated, curved array of such speakers to produce sound field that do not exhibit breaks to the average auditor.

While the invention is shown in only a few of its forms, it is not thus limited but is susceptible to various changes and modifications without departing from the spirit and scope of the invention.

What is claimed is:

1. Sound generating apparatus comprising:

front and back panel members, the front and back panel members having a generally rectangular form and being shaped along their axes of elongation to conform to a curve of a uniform radius or a curve of progressively varying radii;

the front and back panel members being disposed substantially adjacent one another along a major surface of each;

rectangular apertures through the front and back panel members extending in the direction of elongation of the front and back panel members; and a diaphragm positioned between the front and back panel members, the diaphragm having major surfaces in contact with the major surfaces of the front and back panel members, the major surfaces of the diaphragm being bent to conform to the curve of the front and back panel members, and with the diaphragm being substantially aligned with the apertures through the front and back panels for forming a planar loudspeaker for emitting sound; and diaphragm braces extending across the rectangular apertures in a direction perpendicular to the direction of elongation of the rectangular apertures, the diaphragm braces depending from the front and back panel members and abutting the diaphragm along both major faces to divide the diaphragm into sections which can vibrate independently of one another and which stepwise conform to the curve of uniform radius or of progressively varying radii.

2. Sound generating apparatus as set forth in claim 1, further comprising:

a plurality of conductive traces on at least a first major surface of the diaphragm, each of the conductive traces being substantially aligned with a different section of the diaphragm.

3. Sound generating apparatus as set forth in claim 2, further comprising:

a plurality of conductive traces on the second major surface, each of the plurality of conductive traces on the second major surface corresponding to a different one of the plurality of conductive traces on the first major surface to provide a plurality of pairs of conductive traces.

4. Sound generating apparatus as set forth in claim 2, further comprising:

audio drive circuitry connected to supply mutually differentiated drive signals to each of the plurality of conductive traces on the first major surface.

5. Sound generating apparatus as set forth in claim 3, further comprising:

audio drive circuitry including an audio input signal source, the audio drive circuitry being connected to supply mutually differentiated drive signals to each of the pairs of conductive traces.

6. Sound generating apparatus as set forth in claim 5, the audio drive circuitry further comprising:

a plurality of delay lines, with at least one delay line each corresponding to and connected to each pair of conductive traces, and with each delay line being connected to the audio drive signal source to supply time differentiated input signals to each pair of conductive traces.

7. Sound generating apparatus as set forth in claim 6, further comprising:

first and second sets of magnets associated with each pair of conductive traces and lying adjacent the major surfaces of the diaphragm, each set of magnets comprising a plurality of permanent bar magnets disposed in arrays in which the bar magnets are parallel to each other and parallel to corresponding sections of the diaphragm and perpendicular to the direction of elongation of the front and back panel members, with the permanent bar magnets of the first set being narrower and shallower than those of the second set.

8. Sound generating and transmitting apparatus as set forth in claim 7, further comprising:

a plurality of planar loudspeakers connected end to end in a chain.

9. Sound generating and transmitted apparatus as set forth in claim 8, further comprising:

the chain including at least a first curved portion; and the curve to which the front and back members conform being congruent to the curve of the chain at its point of location.

10. Sound generating and transmitting apparatus as set forth in claim 1, further comprising:

a plurality of planar loudspeakers connected end to end in a chain.

11. Sound generating and transmitted apparatus as set forth in claim 10, further comprising:

the chain including at least a first curved portion; and the curve to which the front and back members conform being congruent to the curve of the chain at its point of location.

12. A planar loudspeaker comprising:

a front panel having front and back major surfaces, the front panel defining an aperture connecting the front and back major surfaces;

a back panel having front and back major surfaces which are congruent to the front and back major surfaces of the front panel, with the front major surface of the back panel disposed substantially abutting the back major surface of the front panel;

a diaphragm which is located between the front panel and the back panel, the diaphragm being aligned on the aperture through the front panel and mounted between the panels for vibration;

at least a first diaphragm brace extending across the rectangular apertures in a direction perpendicular to the direction of elongation of the rectangular apertures, the at least first diaphragm brace depending from one of either the front and back panel members and abutting the diaphragm along a first major face to divide the diaphragm into sections which can vibrate independently of one another and which stepwise conform to the curve of uniform radius or of progressively varying radii; and independent circuit traces disposed on each section of the diaphragm further corresponding to the divisions of the aperture.

13. A planar loudspeaker as set forth in claim 12, further comprising:

the front and back panels having elongated rectangular shapes; and the front and back panels being shaped from end to end in the direction of elongation to conform to a curve.

14. A planar loudspeaker as set forth in claim 13, further comprising:

the back panel defining an aperture between its front and back major surfaces; and a second diaphragm brace parallel to and aligned on the at least first diaphragm brace and abutting the diaphragm along a second major face.

15. A planar loudspeaker as set forth in claim 14, further comprising:

drive circuitry connected to the independent circuit traces for applying time differentiated drive signals to the independent circuit traces.

16. A planar loudspeaker as set forth in claim 14, further comprising:

a plurality of bar magnets disposed in each section of the apertures through the front and back apertures, the bar magnets in each section being oriented parallel to any diaphragm brace bordering the section with the bar magnets in the sections of the aperture through the front panel being narrower and shallower than those disposed in the sections of the aperture through the back section.

* * * * *